US006654587B2

(12) United States Patent
Shimoyama

(10) Patent No.: US 6,654,587 B2
(45) Date of Patent: Nov. 25, 2003

(54) CONTINUOUS PAPER PRINTER

(75) Inventor: Atsuhiko Shimoyama, Atsumi-Gun (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/228,271

(22) Filed: Aug. 27, 2002

(65) Prior Publication Data

US 2003/0039497 A1 Feb. 27, 2003

(30) Foreign Application Priority Data

Aug. 27, 2001 (JP) ..... 2001-255866

(51) Int. Cl.[7] ..... G03G 15/00

(52) U.S. Cl. ..... 399/384

(58) Field of Search ..... 347/262, 264; 399/384, 385, 386, 387; 400/582, 583

(56) References Cited

U.S. PATENT DOCUMENTS 5,212,531 A * 5/1993 Monma et al. ..... 399/384
5,929,894 A * 7/1999 Kikuchi ..... 347/262
6,259,868 B1 * 7/2001 Fujii et al. ..... 399/45

FOREIGN PATENT DOCUMENTS

JP 6-278938 10/1994
JP 8-259068 10/1996

* cited by examiner

*Primary Examiner*—Hoang Ngo
(74) *Attorney, Agent, or Firm*—Morrison & Foerster LLP

(57) ABSTRACT

Drive canceling devices are included in the paper supply and conveyance system, and when the leading edge of the continuous paper reaches the fusing device, the driving of the tractor and the conveyance rollers is stopped by the drive canceling devices such that the tractor and the conveyance rollers become passively driven, and the continuous paper is thereafter conveyed by the fusing device. In addition, the amount of movement of the continuous paper is detected by detection means that detects the amount of movement of the continuous paper, and the initial image printing position is controlled based on the detected amount of movement.

17 Claims, 5 Drawing Sheets

CONTINUOUS PAPER PRINTER

The present application claims priority to Japanese Patent Application No. 2001-255866 filed Aug. 27, 2001, the entire content of which is hereby incorporated by reference.

BACKGROUND OF THE INVENTION

1. Field of the Invention

The present invention relates to a continuous paper printer that uses the heat roll fusing method, and more particularly, to a continuous paper printer using which stable paper conveyance and printing performance can be obtained without the use of a buffer mechanism that would otherwise be included in order to provide appropriate tension to the continuous paper.

2. Description of the Related Art

Continuous paper printers using the heat roll fusing method have been available in the conventional art, in which folded continuous paper or rolled-up paper is placed in the apparatus and toner images are transferred and fused while the paper is supplied on a continuous basis. The paper conveyance speed provided by the fusing roller is determined in this type of apparatus by the diameter and the rate of rotation, or rpm, of the fusing roller. However, because the fusing roller becomes hot, the diameter thereof fluctuates due to thermal expansion. Therefore, it is difficult to completely match the conveyance speed of the fusing roller to the image conveyance speed of the image formation area. In addition, where continuous paper is used, because the paper is continuous, once a difference arises between the conveyance speed of the fusing roller and the image conveyance speed of the image formation area, such difference accumulates, causing either a gradual increase in the slackening of the paper or the application of excessive tension to the paper.

Accordingly, continuous paper printers equipped with a buffer mechanism that maintains the tension of the continuous paper between the transfer area and the fusing area at an appropriate level are commercially available. Such a continuous paper printer detects the tension of the continuous paper using the buffer mechanism, and by controlling the rate of rotation of the fusing roller in response to the detected tension, an appropriate level of tension is applied to the continuous paper.

A basic construction of a continuous paper printer equipped with a buffer mechanism (so called buffer arm) is shown in FIG. 8. As shown in FIG. 8, a tractor 102 that supplies and conveys continuous paper 101, conveyance rollers 103 and 105, a conveyance motor 112 that drives these components, a conveyance guide 104 and other components are located in the paper supply area of the continuous paper printer. An image forming unit 110 to form toner images on the surface of the photoreceptor drum 107, a transfer roller 106 and other components are located around the photoreceptor drum 107 in the image formation area. The image forming unit 110 includes a charger, an optical system and a developing device. Because the constructions of these components are in the public domain, they will not be described herein.

A fusing roller 108 that performs heat-roller fusing is located in the fusing area, and a paper eject roller 109 is located downstream therefrom in terms of the paper conveyance direction. Here, if the continuous paper 101 were in contact with the fusing roller 108 while the apparatus is standing by for printing, various problems would occur due to the heat supplied to the fusing roller 108, such as burning of the continuous paper. Therefore, in order to avoid such problems, the apparatus is designed such that the fusing roller 108 separates from the continuous paper while the apparatus is standing by for printing.

A buffer arm 116, a suction fan 111 and other components comprising a buffer mechanism are located between the transfer area and the fusing area. A buffer arm detection plate 117 to detect the paper tension is mounted to this buffer arm 116. The rate of rotation of the fusing roller 108 is then controlled based on the tension thus detected. In addition, a buffer arm retracting mechanism (comprising a retracting motor, for example) 115 that retracts the buffer arm 116 downward is connected to the buffer arm 116. Using this buffer arm retracting mechanism 115, when continuous paper 101 is placed in the printer, the buffer arm 116 can be retracted downward, such that after the leading edge of the continuous paper 101 is introduced to the fusing roller 108, the buffer arm 116 is returned to its original position. The suction fan 111 is used to suck the continuous paper 101 onto the buffer arm 116 so that the leading edge of the continuous paper 101 is reliably led to the fusing roller 108 without separating from the buffer arm 116.

In the continuous paper printer described above, the continuous paper 101 is conveyed to the transfer area for the photoreceptor drum 107 via the tractor 102, the conveyance rollers 103 and 105 and the conveyance guide 104. The continuous paper 101 comes into contact with the photoreceptor drum 107 therein, and the toner image on the photoreceptor drum 107 is transferred to the continuous paper 101 by the transfer roller 106. The continuous paper 101 is then conveyed to the fusing roller 108 via the buffer arum 116, whereby the toner image is fused onto the continuous paper 101. The continuous paper 101 is then ejected outside the printer by the paper eject roller 109.

However, the conventional continuous paper printer described above includes a buffer arm 116 between the transfer area and the fusing area in order to supply an appropriate tension to the continuous paper 101. Therefore, the problem of a large apparatus size has arisen. In addition, when the leading edge of the continuous paper 101 is conveyed toward the fusing roller 108, the buffer arm 116 becomes an obstruction. Therefore, in order to avoid this problem, a retracting mechanism 115 by which to temporarily retract the buffer arm 116 downward is also included. As a result, the apparatus also entails the problem of high cost.

These problems can be eliminated by removing the buffer arm 116. However, removing the buffer arm 116 would make it impossible to supply an appropriate tension to the continuous paper 101 between the transfer area and the fusing area. In other words, due to the changes in the rate of rotation of the fusing roller 108, the tension of the paper would fall outside the proper range. If the fusing roller 108 were to pull the continuous paper 101 with an excessive strength, tearing (deformation or ripping of the tracking holes formed on either side of the paper) would occur. It would then become impossible to control the amount by which to convey the continuous paper 101, and the initial printing position on each page would be likely to shift. Conversely, if the continuous paper 101 were too slack, the tension of the continuous paper 101 would become insufficient, resulting in creasing, and a loop would form in the continuous paper 101, resulting in the contact between the unfused toner image and the printer components, which would lead to smudging of the image. As described above, removing the buffer arm 116 would prevent stable conveyance and printing performance from being achieved.

SUMMARY OF THE INVENTION

A main object of the present invention is to provide a continuous paper printer by which it is possible, via the provision of an appropriate tension to the continuous paper and the control of the initial printing position, to obtain stable paper conveyance and printing performance without using a buffer mechanism.

In order to resolve the problems identified above, the continuous paper printer pertaining to the present invention has paper conveyance means to supply and convey continuous paper, an image carrier that carries images, transfer means that transfers the image carried on the image carrier to the continuous paper conveyed by the paper conveyance means, fusing means that causes the continuous paper onto which the image has been transferred by the transfer means to pass between rotating units that are mutually in contact, thereby fusing the image on the continuous paper, canceling means that stops the driving of the paper conveyance means after the leading edge of the continuous paper reaches the fusing means, detection means that detects the amount of movement of the continuous paper, and control means that controls the initial image printing position based on the amount of movement detected by the detection means.

In this continuous paper printer, the image on the image carrier is transferred by the transfer means onto the continuous paper supplied and conveyed by the paper conveyance mans, and subsequently, the transferred image is fused onto the paper by the fusing means. Here after the continuous paper is placed in the printer and the leading edge thereof reaches the fusing means, the driving of the paper conveyance means is stopped by the canceling means. In other words, the paper conveyance means comes to move via passive driving. Therefore, the continuous paper thereafter is conveyed at the conveyance speed of the fusing means. Consequently, even when the conveyance speed of the fusing means changes, the continuous paper is pulled with a constant tensile force by the fusing means at all times. Therefore, an appropriate tension can be supplied to the continuous paper at all times without a buffer mechanism. As a result, stable conveyance performance can be obtained. In addition, because no buffer mechanism is included, a retracting mechanism to is not needed, which contributes to making the printer smaller in size and less expensive to manufacture.

However, where the conveyance of the continuous paper is performed by the fusing means, when the conveyance speed of the fusing means fluctuates, the amount of movement of the continuous paper per unit of time fluctuates as well. In addition, because continuous paper is used, such variations in the amount of movement accumulate, causing the initial printing position on each page to shift in a cumulative fashion.

In view of this possible problem, this continuous paper printer detects the amount of movement of the continuous paper via the detection means, and controls via the control means the initial image printing position based on the amount of movement detected by the detection means. Consequently, the initial printing position is reset for each page, so that there will be no accumulated shift in the initial printing position. In other words, even when the conveyance speed of the fusing means changes, there will be no shift in the initial printing position for each page. Therefore, highly stable printing performance can be obtained.

In the continuous paper printer of the present invention, it is preferred that the paper conveyance means include a rotating unit having multiple protrusions that convey the continuous paper, and that the detection means detect the amount of movement of the continuous paper based on the rate of rotation of the rotating unit. Here, the rotating unit may comprise a continuous belt mounted to a tractor, a sprocket, or a grip roller, for example.

By including a rotating unit having multiple protrusions, the paper conveyance means can convey the continuous paper without the paper slipping thereon. Consequently, a proportional relationship results between the rate of rotation of the rotating unit and the amount of movement of the continuous paper. The amount of movement of the continuous paper is then accurately detected by the detection means based on the rate of rotation of the rotating unit. As a result, initial printing position control can be performed with precision.

In addition, it is preferred that the continuous paper printer of the present invention include a guide plate that is located between the transfer means and the fusing means and guides the continuous paper to the fusing means, as this enables the leading edge of the continuous paper to be reliably introduced to the fusing means when the continuous paper is set in the printer.

It is acceptable if an electromagnetic clutch is used for the canceling means that stops the driving of the paper conveyance means.

It is acceptable if more than one paper conveyance means is included. In this case, there may be canceling means for each paper conveyance means to stop the driving thereof. Conversely, it is also acceptable if only specific paper conveyance means have canceling means.

Furthermore, it is acceptable if the control means controls the initial image printing position by changing the timing of issuance of the signal that instructs the initial image printing position.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
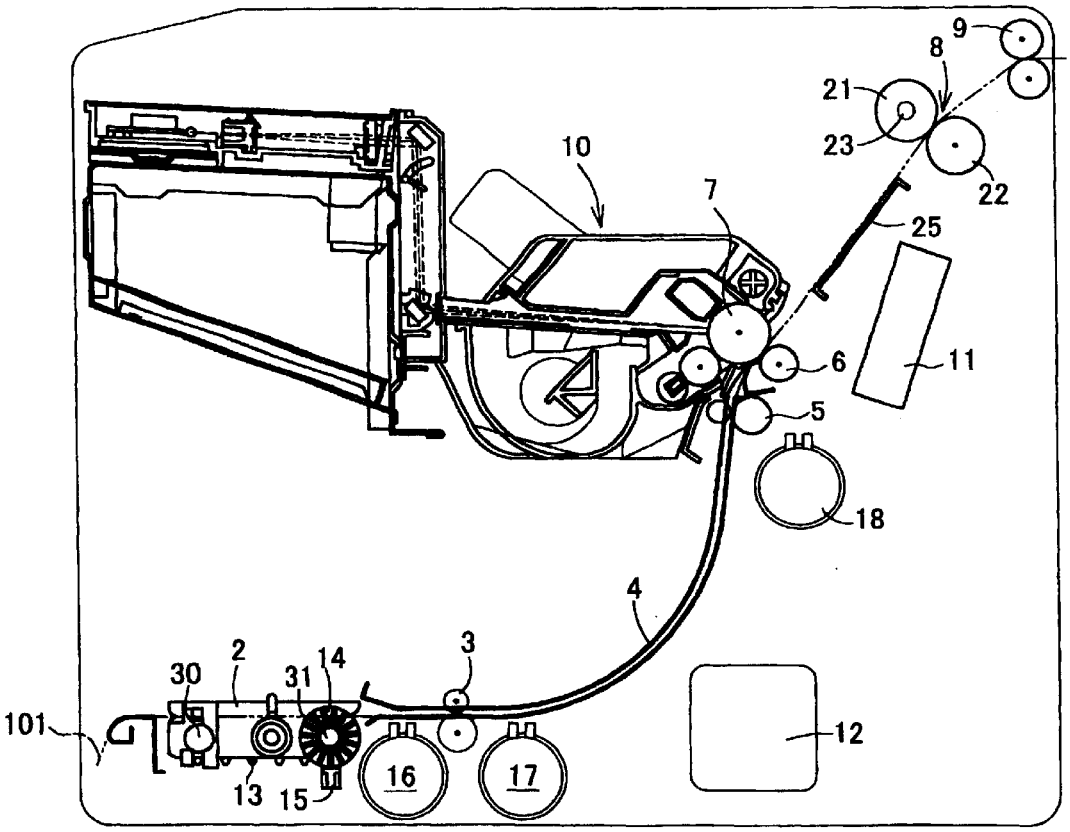
FIG. 1 is a cross-sectional view showing the basic construction of a continuous paper printer pertaining to an embodiment of the present invention.

The most preferred embodiment in which the present invention is specifically applied is described in detail below with reference to the drawings. FIG. 1 shows the basic construction of a continuous paper printer pertaining to the embodiment. This continuous paper printer does not include a buffer mechanism (buffer arm), as shown in FIG. 1. The paper supply area of this continuous paper printer comprises a tractor 2 that supplies and conveys the continuous paper 101, conveyance rollers 3 and 5, a conveyance motor 12 that drives these components, a conveyance guide 4 and other components. Also included are a drive canceling device 16 that stops the driving of the tractor 2, a drive canceling device 17 that stops the driving of the conveyance roller 3, and a drive canceling device 18 that stops the driving of the conveyance roller 5. The tractor 2 and the conveyance rollers 3 and 5 are driven backward during backfeeding.

The tractor 2 includes two rotating shafts 30 and 31. A continuous belt including multiple tractor pins 13 that engage with the conveyance holes formed on either side of the continuous paper 101 is placed around pulleys (not shown) that rotate together with the rotational shafts 30 and 31. In addition, a disk-like movement amount detection plate 14 that includes multiple (15) notches formed at equal intervals is mounted to the rotational shaft 31. This movement amount detection plate 14 rotates together with the rotational shaft 31. A movement amount detection sensor 15 that detects the notches in the movement amount detection plate 14 is located directly under the movement amount detection plate 14. The amount of movement of the continuous paper 101 conveyed by the tractor 2 is calculated based on the output from the movement amount detection sensor 15. The method by which the amount of movement is calculated is described below.

A photoreceptor drum 7 as well as an image forming unit 10 to form toner images on the surface of the photoreceptor drum 7, a transfer roller 6 that transfers the toner image formed on the photoreceptor drum 7 to the continuous paper 101 and other components, which are located around the photoreceptor drum 7, comprise the image formation area. The image forming unit 10 includes a charger, an optical system, a developing device, etc. Because these components are public domain components, their constructions will not be described herein.

Furthermore, a fusing device 8 that performs heat-roller fusing and a paper eject roller 9 are located downstream from the image formation area in terms of the direction of paper conveyance. The fusing device 8 includes a heat roller 21 and a backup roller 22. The heat roller 21 has a built-in heater 23. When the printer is standing by for printing, the heat roller 21 and the backup roller 22 separate from the continuous paper, such that burning or other damage to the continuous paper 101 due to the heat supplied by the heater 23 to the heat roller 21 will be prevented. In addition, the heat roller 21 and the backup roller 22 are separated during backfeeding.

A guide 25 and a suction fan 11 are located between the area at which the photoreceptor drum 7 and the transfer roller 6 face each other (i.e., the transfer area) and the fusing device 8. The guide 25 is used in order to smoothly convey the continuous paper 101 between the transfer area and the fusing device 8. By including this guide 25, the leading edge of the continuous paper 101 is reliably conveyed to the fusing device 8 when it is placed in the printer. The suction fan 11 is used in order to pull the continuous paper 101 to the guide 25 such that the leading edge of the continuous paper 101 is reliably led to the fusing device 8 without separating from the guide 25.

Figure 2:
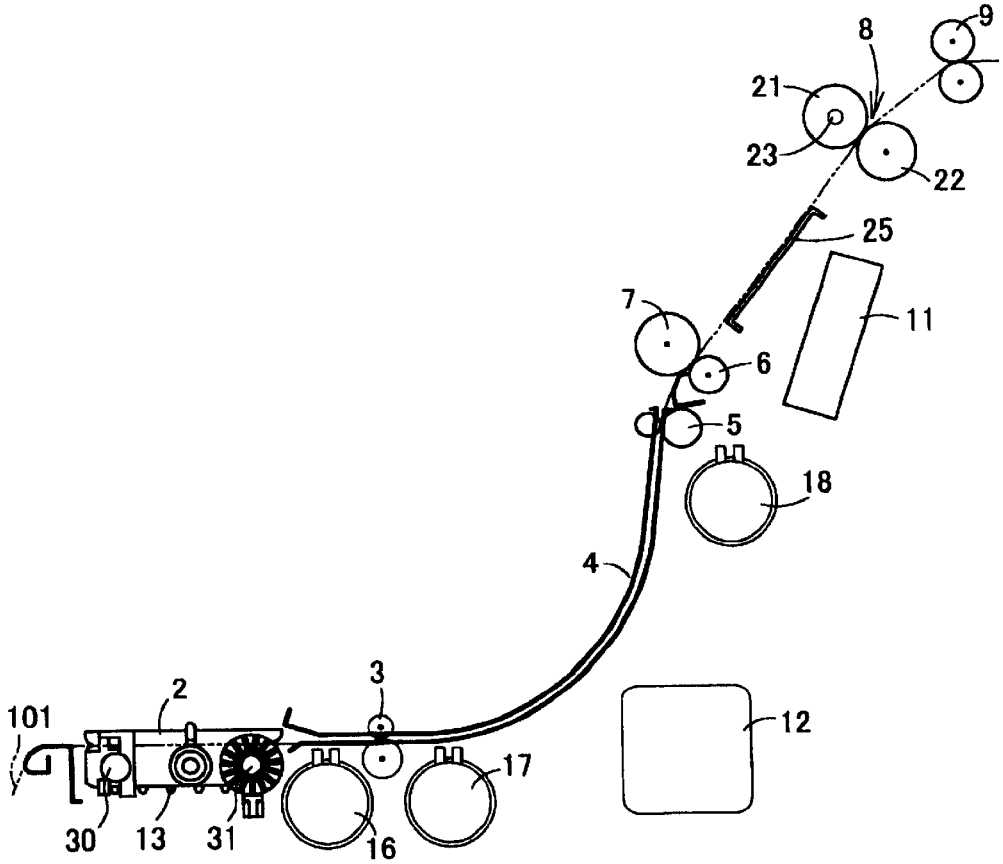
FIG. 2 is a drawing to explain the operation of the continuous paper printer.

The operation of the continuous paper printer having the construction described above will now be described with reference to FIG. 2. The conveyance holes formed on either side of the continuous paper 101 first engage with the tractor pins 13 formed on the continuous belt placed over the pulleys (not shown) that rotate together with the rotational shafts 30 and 31 of the tractor 2. When the rotational shaft 31 is driven by the conveyance motor 12, the tractor pins 13 formed on the continuous belt move so as to supply and convey the continuous paper 101. The continuous paper 101 thus supplied and conveyed by the tractor 2 is guided via the conveyance roller 3, the conveyance guide 4 and the conveyance roller 5 to the area at which the photoreceptor drum 7 and the transfer roller 6 face each other. Simultaneously with the supply of the continuous paper 101, a toner image is formed on the photoreceptor drum 7 by the image forming unit 10.

When the continuous paper 101 enters the area at which the photoreceptor drum 7 and the transfer roller 6 face each other (i.e., the transfer area), it is pressed by the transfer roller 6 onto the photoreceptor drum 7. When this occurs, a transfer bias voltage is impressed to the transfer roller 6, such that the toner image formed on the photoreceptor drum 7 is transferred to the continuous paper 101 by the transfer roller 6. The continuous paper 101 onto which the toner image has not yet been fused is subsequently conveyed to the fusing device 8 along the guide 25, whereby the image is fused onto the paper. The continuous paper 101 onto which the toner image has been fused is further conveyed by the paper eject roller 9 and ejected out of the printer main unit.

The fusing device 8 fuses the toner image to the continuous paper 101 via heat of approximately 200° C. combined with pressure, using the heat roller 21 having a built-in heater 23 and the backup roller 22. Therefore, the diameter of the heat roller 21 changes due to thermal expansion. When the diameter of the heat roller 21 changes, the speed at which the paper is conveyed by the fusing device 8 also changes, which supplies an inappropriate level of tension (i.e., too much tension or too little tension) to the continuous paper 101.

Therefore, the continuous paper printer pertaining to this embodiment includes drive canceling devices 16, 17 and 18 comprising electromagnetic clutches, for example, in the paper supply and conveyance system, as described above. These devices switch the driving of the paper supply and conveyance system after the leading edge of the continuous paper 101 reaches the fusing device 8 such that the system becomes passively driven. In other words, the driving of the tractor 2 is stopped by the drive canceling device 16, and the tractor 2 thereafter becomes passively driven. Similarly, the driving of the conveyance rollers 3 and 5 is stopped by the drive canceling devices 17 and 18, respectively, and the conveyance rollers 3 and 5 thereafter become passively driven.

These drive canceling devices 16, 17 and 18 are included as described above in order to minimize fluctuations in the speed of the continuous paper 101 when the driving of the tractor 2 and the conveyance rollers 3 and 5 are changed to passive driving. Such devices make shifting of the transfer position and the like less likely to occur. Where a slight shift in the transfer position is to be permitted, a drive canceling device may be located at a position prior to the position at which the driving power from the conveyance motor 12 is separately supplied to each driven component. In this case, because only one drive canceling device is used, a cost advantage is obtained. In addition, where the conveyance power of the conveyance rollers 3 and 5 is very small, it is acceptable if only the tractor 2 has a drive canceling device 16. The same applies when no conveyance rollers 3 or 5 are included in the printer.

As a result of the inclusion of the drive canceling devices 16, 17 and 18 and the switching the driving of the tractor 2 and the conveyance rollers 3 and 5 to passive driving, the conveyance speed of the continuous paper 101 is determined by the conveyance speed of the fusing device 8. Therefore, even where the diameter of the heat roller 21 changes due to thermal expansion, resulting in a change in the speed of the conveyance performed by the heat roller 21 and the backup roller 22, the application of an inappropriate level of tension to the continuous paper 101 does not occur.

However, when the continuous paper 101 is conveyed based on the rotation of the heat roller 21 and the backup roller 22, the amount of movement of the continuous paper 101 per unit of time varies as the conveyance speed of these rollers changes. In the case of a continuous paper printer, the variations in the amount of movement accumulate, resulting in the phenomenon that the initial printing position on each page gradually and increasingly becomes shifted. In other words, a shift in the initial printing position takes place.

Figure 3:
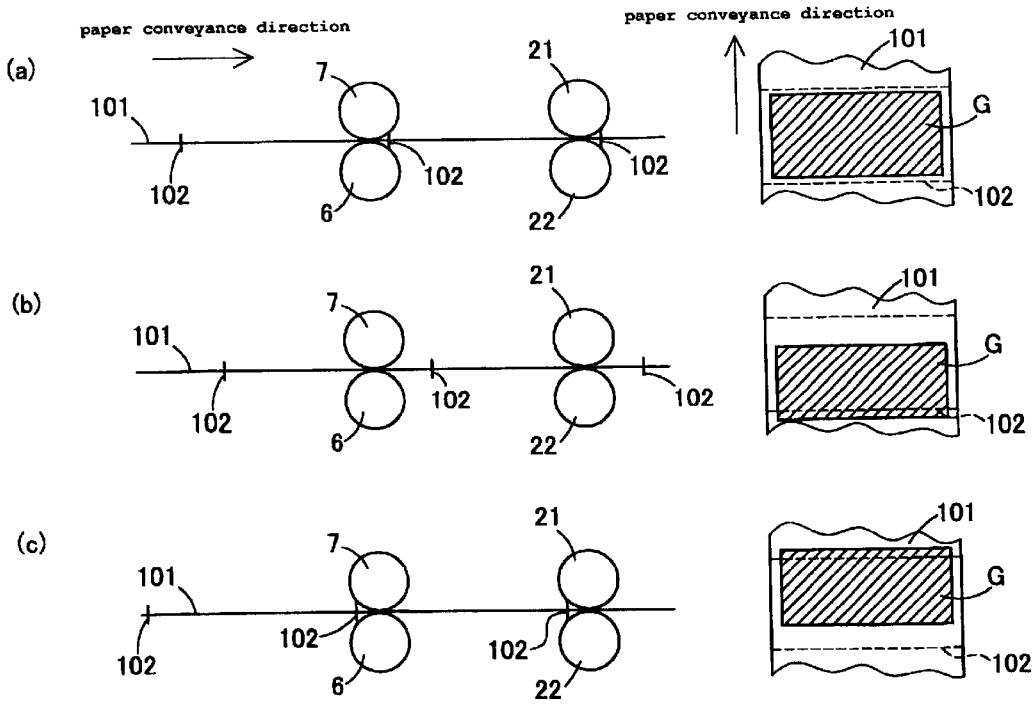
FIG. 3 is a drawing to explain the shifting of the printing position.
Figure 4:
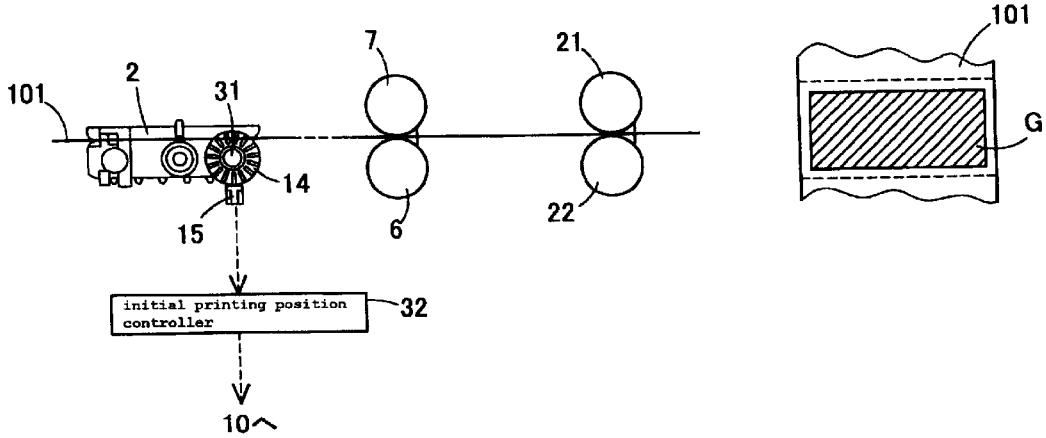
FIG. 4 is a drawing to explain the initial printing position control.

The shift in the printing position that occurs as the paper conveyance speed of the fusing device 8 changes will now be described with reference to FIG. 3. FIG. 3(*a*) shows a situation in which there is no shift in the printing position. FIG. 3(*b*) shows a situation in which the image G is shifted toward the rear from the normal position. FIG. 3(*c*) shows a situation in which the image G is shifted toward the front from the normal position. Because the printing for the next page is performed based on a TOP signal (a page printing start reference signal for the secondary scanning direction) that is output at certain intervals, if the conveyance speed of the fusing device 8 varies, the printing position becomes shifted. Therefore, as shown in FIG. 3(*a*), where the heat roller 21 and the backup roller 22 are conveying the continuous paper 101 at a prescribed speed (design value), the image G is printed at the normal position. The number 102 indicates the perforations formed between the pages of the continuous paper 101.

Where the heat roller 21 and the backup roller 22 are rotating at a speed higher than the prescribed speed (design value), the continuous paper 101 is conveyed by a larger amount than the prescribed amount, as shown in FIG. 3(*b*). As a result, the image G is printed with a rearward shift from the normal position. Conversely, where the heat roller 21 and the backup roller 22 are rotating at a speed lower than the prescribed speed (design value), the continuous paper 101 is conveyed by a smaller amount than the prescribed amount, as shown in FIG. 3(*c*). As a result, the image G is printed with a frontward shift from the normal position.

Where the image G is printed over the perforations 102, as shown in FIG. 3(*b*) and FIG. 3(*c*), the same image must be printed again, which involves considerable work. Therefore, the occurrence of such a situation must be prevented. In the continuous paper printer pertaining to this embodiment, therefore, initial printing position control is performed. In other words, as shown in FIG. 4, a movement amount detection plate 14 is mounted to the rotational shaft 31 of the tractor 2 such that the rate of rotation of the movement amount detection plate 14 is detected by the movement amount detection sensor 15. Consequently, the actual amount of movement of the continuous paper 101 is determined. When the continuous paper 101 has been conveyed by as much as one page, a TOP signal is output from the initial printing position controller 32. The initial printing position for the next page is corrected based on this TOP signal. Consequently, variations in the amount of movement of the paper do not accumulate in the subsequent pages, and as a result the image G is printed at the normal position at all times.

The shift in the printing position and initial printing position control will now be described using specific values. Here, the design value for the conveyance speed of the fusing device 8 is assumed to be 127 mm/s, and the length of one page of the continuous paper 101 is assumed to be 215.9 mm (8.5"). The TOP signal then is output every 215.9/127=1.7 (seconds).

In addition, the diameter of the heat roller 21 at the adjusted temperature of 200° C. is assumed to be 29.0 mm (design value). It is also assumed that this diameter becomes 29.1 mm due to thermal expansion when the temperature of the roller reaches 210° C. The conveyance speed achieved by the fusing device 8 then increases to (29.1/29.0)×127=127.44 (mm/s).

When the conveyance speed of the fusing device 8 changes from 127 mm/s to 127.44 mm/s as described above, the initial image printing position for one page of the continuous paper 101 becomes shifted rearward from the normal position by as much as (127.44—127)×1.7=0.75 (mm). In the case of continuous paper, this amount of shift accumulates. In other words, the amount of shift gradually increases as the continuous paper moves on to the second and third page, such that the amount of shift becomes 1.50 mm for the second page and 2.25 mm for the third page. Consequently, the image ends up being formed both inside and outside the printing area for one page.

Similarly, it is assumed that when the temperature of the heat roller 21 reaches 190° C., the diameter thereof becomes 28.9 mm. Then, because the conveyance speed of the fusing device 8 declines to 126.56 mm/s, the initial image printing position becomes shifted frontward from the normal position by 0.75 mm per page of the continuous paper 101.

However, initial printing position control is performed in the continuous paper printer pertaining to this embodiment in the manner described below. First, when the rotational shaft 31 of the tractor 2 rotates once, the continuous paper 101 moves by 63.5 mm (2.5"). Therefore, when one page of the continuous paper 101 has been conveyed, the rotational shaft 31 has rotated 3.4 times. As the rotational shaft 31 rotates, the notches in the movement amount detection plate 14 are detected by the movement amount detection sensor 15. Specifically, because 15 notches are formed in the movement amount detection plate 14 at equal intervals, when the continuous paper 101 has been conveyed by one page by the tractor 2, 3.4×15=51 notches are detected.

When 51 notches formed in the movement amount detection plate 14 have been detected by the movement amount detection sensor 15, a TOP signal is output from the initial printing position controller 32. Because the initial printing position is reset for each page by this signal, there will be no accumulated shift in the printing position. In other words, even when the diameter of the heat roller 21 changes and the conveyance speed of the fusing device 8 changes, the initial printing position for each page does not become shifted. Consequently, extremely stable printing performance can be obtained.

In the continuous paper printer pertaining to this embodiment described above in detail, the paper supply conveyance system includes drive canceling devices 16, 17 and 18. After the leading edge of the continuous paper 101 reaches the fusing device 8, the driving of the tractor 2 is stopped by the drive canceling device 16 and the tractor 2 becomes passively driven. Similarly, the driving of the conveyance rollers 3 and 5 is stopped by the drive canceling devices 17 and 18 and the conveyance rollers 3 and 5 become passively driven. Consequently, the continuous paper 101 is thereafter conveyed based on the conveyance speed of the fusing device 8. Therefore, even where the conveyance speed of the fusing device 8 changes, the conveyance paper 101 is pulled with a certain tension at all times by the fusing device 8. Therefore, an appropriate level of tension is supplied to the continuous paper 101 at all times even without a buffer mechanism, and stable conveyance performance can be obtained.

In addition, a movement amount detection plate 14 in which 15 notches are formed is mounted to the rotational shaft 31 of the tractor 2, and a movement amount detection sensor 15 that detects these notches is included in the apparatus. When 51 notches (equivalent to one page) have been detected by this detection sensor 15, a TOP signal is output from the initial printing position controller 32. Printing is begun based on this TOP signal. Therefore, because the initial printing position is reset for each page, there will be no accumulation of shifts in the printing position. In other words, even where the conveyance speed of the fusing device 8 changes, the printing position does not shift, and very stable printing performance can be obtained.

Figure 5:
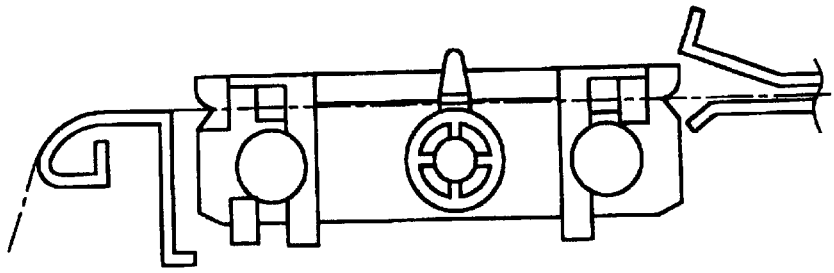
FIG. 5 is a drawing showing the basic construction of a tractor.
Figure 6:
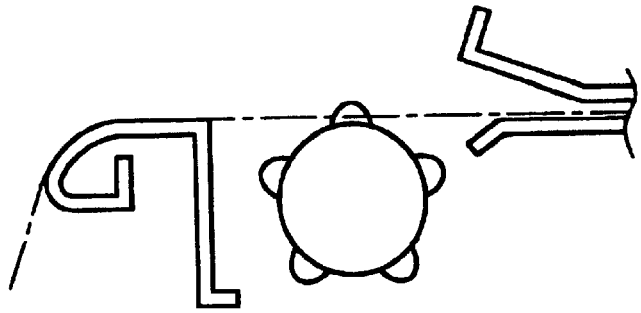
FIG. 6 is a drawing showing the basic construction of a sprocket.
Figure 7:
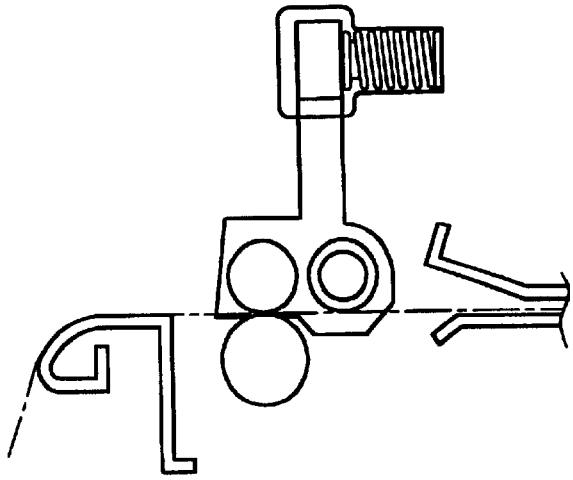
FIG. 7 is a drawing showing the basic construction of a grip roller.
Figure 8:
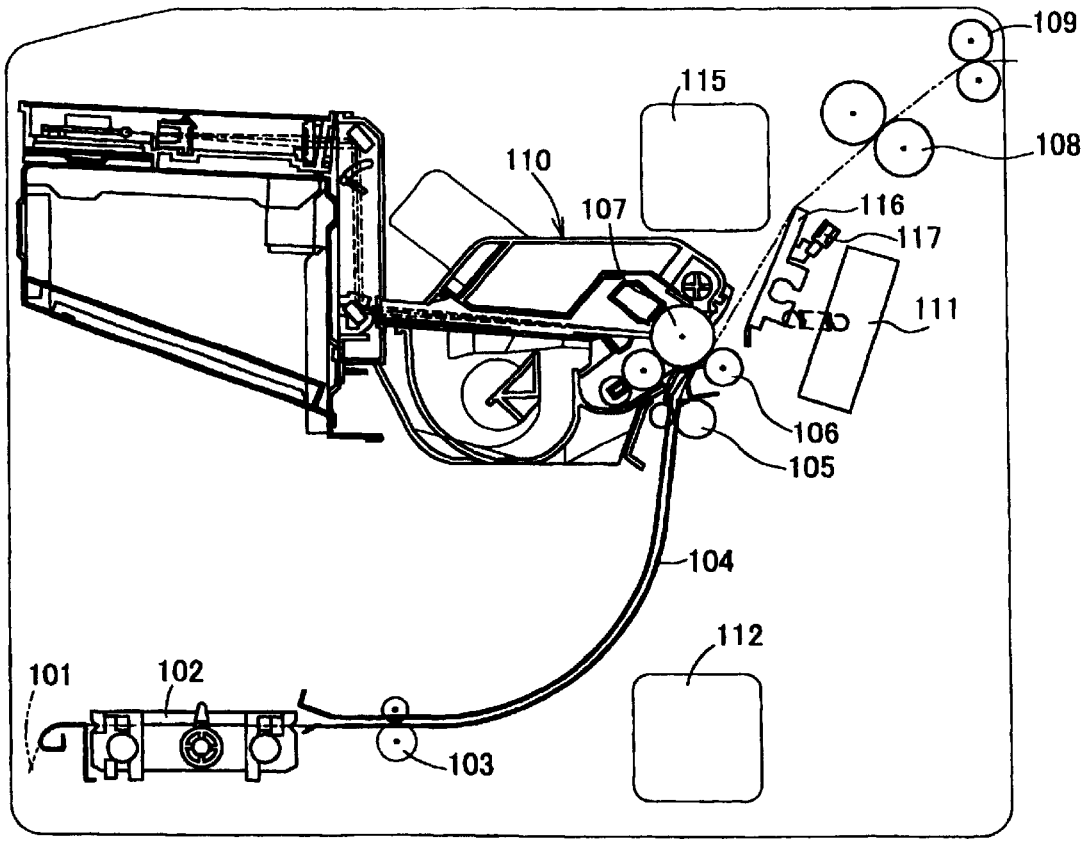
FIG. 8 is a cross-sectional view showing the basic construction of the conventional continuous paper printer.

The embodiment described above is only an example, and does not limit the present invention in any manner whatsoever. Various improvements and modifications are naturally possible within the essential scope of the present invention. For example, the continuous paper is supplied and conveyed by the tractor shown in FIG. 5 in the embodiment described above, but such paper supply and conveyance may be performed by a device different from the tractor so long as the device is capable of supplying and conveying the continuous paper without the paper slipping thereon. The sprocket shown in FIG. 6 or the grip roller (a roller with numerous small raised bands having a diameter of 0.03 mm or a height of approximately 0.07 mm) shown in FIG. 7 may be used, for example. The specific values shown as examples in the embodiment described above are, needless to say, mere examples.

According to the present invention, as described above, a continuous paper printer by which the continuous paper is provided with an appropriate tension without the use of a buffer mechanism, and by which stable paper conveyance and printing performance can be obtained, is provided through the control of the initial printing position.

Although the present invention has been fully described by way of examples with reference to the accompanying drawings, it is to be noted that various changes and modifications will be apparent to those skilled in the art. Therefore, unless such changes and modification depart from the scope of the present invention, they should be construed as being included therein.

What is claimed is:

1. A continuous paper printer comprising:

a paper conveyer which conveys continuous paper;

an image carrier which carries images;

a transfer which transfers the image carried on the image carrier to the continuous paper conveyed by the paper conveyer;

a fuser which causes the continuous paper onto which the image has been transferred by the transfer to pass between rotating units that are mutually in contact, thereby fusing the image on the continuous paper;

a driving controller which stops driving of the paper conveyer after a leading edge of the continuous paper reaches the fuser;

a detector which detects an amount of movement of the continuous paper; and a printing controller which controls an initial image printing position based on the amount of movement detected by the detector.

2. The continuous paper printer of claim 1, wherein the paper conveyer includes a rotating unit having multiple protrusions that convey the continuous paper, and the detector detects the amount of movement of the continuous paper based on a rate of rotation of the rotating unit.

3. The continuous paper printer of claim 2, wherein the rotating unit comprises a continuous belt mounted to a tractor.

4. The continuous paper printer of claim 2, wherein the rotating unit comprises a sprocket.

5. The continuous paper printer of claim 2, wherein the rotating unit comprises a grip roller.

6. The continuous paper printer of claim 1, further comprising:

a guide plate which is located between the transfer and the fuser and guides the continuous paper to the fuser.

7. The continuous paper printer of claim 1, wherein the driving controller comprises an electromagnetic clutch.

8. The continuous paper printer of claim 1, wherein the paper conveyer comprises two conveyer units.

9. The continuous paper printer of claim 8, wherein the drive controller stops driving of the two paper conveyer units.

10. The continuous paper printer of claim 8, wherein the drive controller stops driving of only one of the two paper conveyer units.

11. The continuous paper printer of claim 1, wherein the printing controller controls the initial image printing position by changing a timing of issuance of a signal that instructs the initial image printing position.

12. A continuous paper printer comprising:

a paper conveyer which conveys continuous paper;

an image carrier which carries images;

a transfer which transfers the image carried on the image carrier to the continuous paper conveyed by the paper conveyer;

a fuser which causes the continuous paper onto which the image has been transferred by the transfer to pass between rotating units that are mutually in contact, thereby fusing the image on the continuous paper;

a driving controller which stops driving of the paper conveyer after a leading edge of the continuous paper reaches the fuser; and a printing controller which controls an initial image printing position by changing a timing of issuance of a signal that instructs the initial image printing position based on an amount of movement of the continuous paper.

13. The continuous paper printer of claim 12, further comprising:

a guide plate which is located between the transfer and the fuser and guides the continuous paper to the fuser.

14. The continuous paper printer of claim 12, wherein the driving controller comprises an electromagnetic clutch.

15. The continuous paper printer of claim 12, wherein the paper conveyer comprises two conveyer units.

16. The continuous paper printer of claim 15, wherein the drive controller stops driving of the two paper conveyer units.

17. The continuous paper printer of claim 15, wherein the drive controller stops driving of only one of the two paper conveyer units.

* * * * *